US008863718B2

(12) United States Patent
Rebello et al.

(10) Patent No.: US 8,863,718 B2
(45) Date of Patent: Oct. 21, 2014

(54) LOW THERMAL CONDUCTIVITY PISTON AND METHOD OF CONSTRUCTION THEREOF

(75) Inventors: Jose Rebello, Ann Arbor, MI (US); Thomas Egerer, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 202 days.

(21) Appl. No.: 12/851,654

(22) Filed: Aug. 6, 2010

(65) Prior Publication Data

US 2011/0030645 A1 Feb. 10, 2011

Related U.S. Application Data

(60) Provisional application No. 61/231,783, filed on Aug. 6, 2009.

(51) Int. Cl.
*F01B 31/08* (2006.01)

(52) U.S. Cl.
USPC ..... 123/193.6; 123/41.35

(58) Field of Classification Search
USPC ..... 123/193.6, 41.35; 92/216–220; 29/888.042
See application file for complete search history.

(56) References Cited

U.S. PATENT DOCUMENTS

| | | | | |
|---|---|---|---|---|
| 4,242,948 | A | 1/1981 | Stang et al. | |
| 4,343,229 | A | 8/1982 | Tsuzuki et al. | |
| 4,346,646 | A * | 8/1982 | Ellermann | 92/220 |
| 4,419,925 | A | 12/1983 | Tsuzuki et al. | |
| 4,553,472 | A | 11/1985 | Munro et al. | |
| 5,913,960 | A | 6/1999 | Fletcher-Jones | |
| 6,164,261 | A * | 12/2000 | Kruse | 123/193.6 |
| 6,318,243 | B1 | 11/2001 | Jones | |
| 6,729,291 | B1 | 5/2004 | Scharp et al. | |
| 7,362,995 | B2 * | 4/2008 | Nuita | 399/329 |
| 2005/0034598 | A1 * | 2/2005 | Ribeiro et al. | 92/186 |
| 2009/0229804 | A1 * | 9/2009 | Zebuhr | 165/166 |

FOREIGN PATENT DOCUMENTS

| | | | |
|---|---|---|---|
| CN | 1596335 | A | 3/2005 |
| CN | 100339584 | C | 9/2007 |
| JP | 04-321759 | A | 11/1992 |
| KR | 1020030039004 | A | 5/2003 |
| WO | WO 03-036045 | A1 | 5/2003 |

* cited by examiner

*Primary Examiner* — M. McMahon
(74) *Attorney, Agent, or Firm* — Robert L. Stearns; Dickinson Wright, PLLC

(57) ABSTRACT

A piston and method of construction are provided. The piston includes an upper crown having a combustion surface with an upper land depending therefrom and a lower crown having a pair of pin bosses that depend to a pair of laterally spaced, axially aligned pin bores. The upper crown is constructed as a monolithic piece of a first material having a thermal conductivity within a range of about 7 to 25 W/m-K. The lower crown is constructed from a low grade steel material having a thermal conductivity higher than the upper crown. The upper crown is joined directly to the lower crown, wherein the upper crown acts as a barrier to thermal conductivity and thus, the heat within a combustion chamber housing the piston for reciprocation therein is maintained and maximized.

15 Claims, 2 Drawing Sheets

LOW THERMAL CONDUCTIVITY PISTON AND METHOD OF CONSTRUCTION THEREOF

CROSS-REFERENCE TO RELATED APPLICATIONS

This application claims the benefit of U.S. Provisional Application Ser. No. 61/231,783, filed Aug. 6, 2009, which is incorporated herein by reference in its entirety.

BACKGROUND OF THE INVENTION

1. Technical Field

This invention relates generally to internal combustion engines, and more particularly to pistons and their method of construction.

2. Related Art

Engine manufacturers are encountering increasing demands to improve engine efficiencies and performance, including, but not limited to, improving fuel economy, improving fuel combustion, reducing oil consumption, and increasing the exhaust temperature for subsequent use of the heat within the vehicle. In order to achieve these goals, the engine running temperature in the combustion chamber needs to be increased. However, while desirable to increase the temperature within the combustion chamber, it remains necessary to maintain the piston at a workable temperature. By keeping the piston at a workable temperature in the combustion chamber, the onset of carbon build-up on the upper land of the piston is controlled, which in turn improves the running efficiency of the engine. As such, although believed desirable to increase the temperature in the combustion chamber, there is a tradeoff in that increasing the combustion chamber temperature can result in increase of overall temperature of the piston, particularly in the upper land region.

Some attempts have been made to construct pistons having an ability to increase the combustion chamber running temperature. One known attempt uses a ceramic coating on an underlying metal piston. However, these pistons typically experience strength, durability and processing issues making them unsuitable for use. Other attempts include using moderate stainless steel having a chromium content between 4-6% and a thermal conductivity of about 33 W/m-K, and although useful to an extent, these efforts have not provided the necessary reduction in thermal conductivity to achieve and sustain the increased running temperatures desired.

A piston constructed in accordance with this invention overcomes the disadvantages of known piston constructions, including those associated with ceramic coated pistons. As such, a piston constructed in accordance with this invention facilitates increasing the combustion chamber temperature, thereby providing enhanced running efficiencies, while having high strength and durability and also inhibiting the potential for carbon build-up.

SUMMARY OF THE INVENTION

In accordance with one aspect of the invention, a piston includes an upper crown having a combustion surface with an upper land depending therefrom and a lower crown welded directly to the upper crown. The lower crown has a pair of pin bosses that depend from the upper crown to a pair of laterally spaced, axially aligned pin bores. The upper crown is constructed as a monolithic piece of a first material having a thermal conductivity within a range of about 7 to 25 W/m-K. The lower crown is constructed from a low grade steel material having a thermal conductivity higher than the upper crown. As such, the upper crown acts as a barrier to thermal conductivity and thus, the heat within a combustion chamber housing the piston for reciprocation therein is maintained and maximized. Accordingly, the running efficiencies and overall performance of the engine are enhanced by increasing the exhaust gas temperature for use in downstream engine applications, increasing fuel economy, facilitating complete fuel combustion, and inhibiting the formation of carbon build-up on the piston upper land.

In accordance with another aspect of the invention, the temperature within the combustion chamber is maintained above about 300 degrees Celsius in use, which has been determined to be an approximate upper temperature limit at which carbon build-up ceases.

In accordance with another aspect of the invention, the thermal conductivity of the high grade stainless steel material is within a range of about 7 to 25 W/m-K.

In accordance with another aspect of the invention, the upper crown is constructed of 400 series stainless steel having between about 11.5 to 13.5 wt % chromium and a thermal conductivity of about 23 W/m-K.

In accordance with another aspect of the invention, the upper crown is constructed of 600 series stainless steel having between about 15 to 18 wt % chromium and a thermal conductivity of about 13 W/m-K.

In accordance with another aspect of the invention, the upper crown is constructed of Titanium having a thermal conductivity of approximately 7.8 W/m-K.

In accordance with yet another aspect of the invention, a method of constructing a piston for an internal combustion engine is provided. The method includes forming an upper crown as a monolithic piece of a first material having a thermal conductivity within a range of about 7 to 25 W/m-K and forming the upper crown having an upper combustion surface with an upper land depending therefrom, with the upper land having at least annular one ring groove configured for receipt of a piston ring. In addition, the method includes forming a lower crown of a low grade steel alloy material having a thermal conductivity higher than the upper crown with the lower crown having a pair of pin bosses providing a pair of laterally spaced, axially aligned pin bores. And further, welding the lower crown directly to the upper crown.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
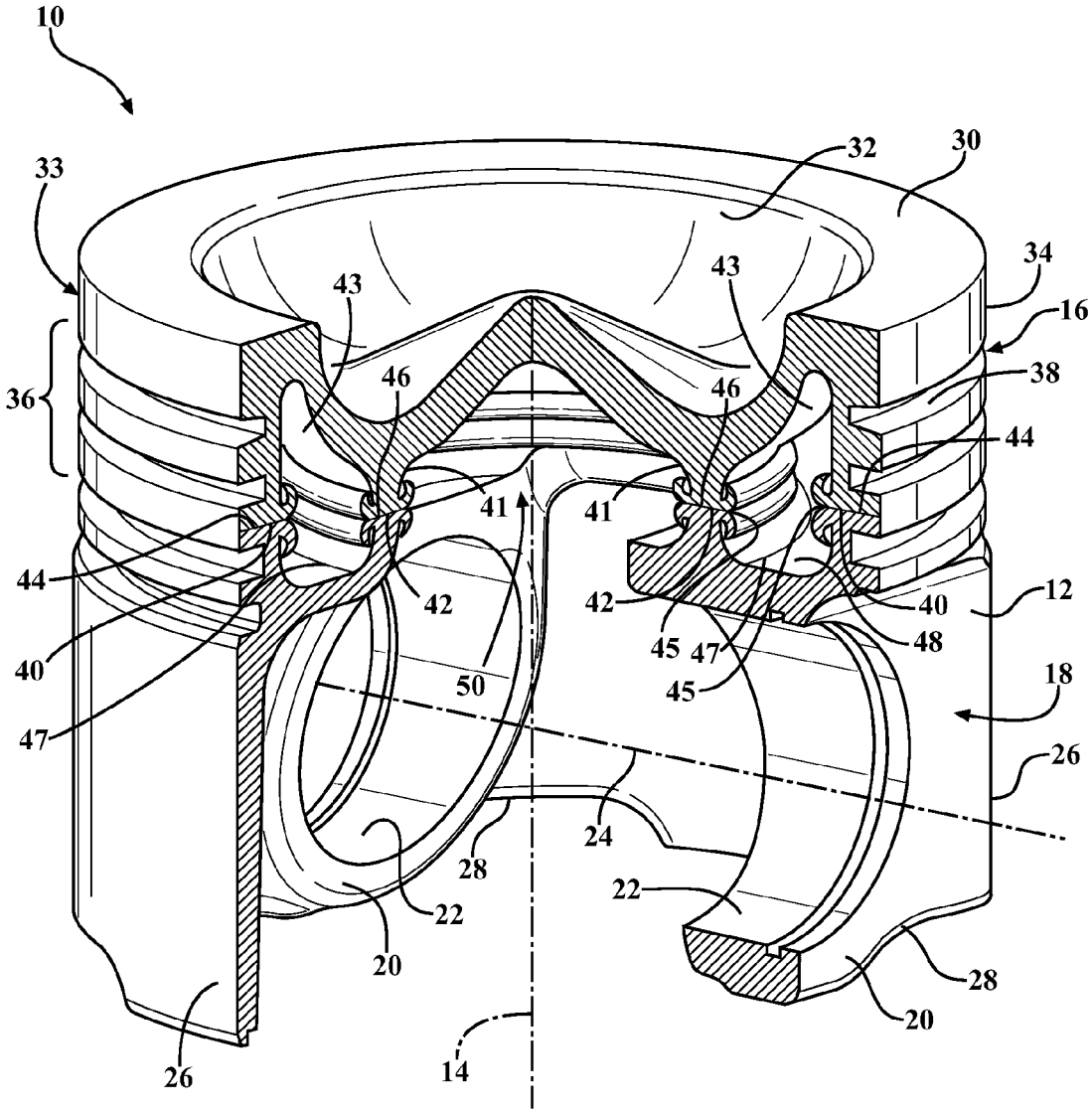
FIG. 1 is a partially sectioned perspective view of a piston constructed in accordance with one aspect of the invention.
Figure 2:
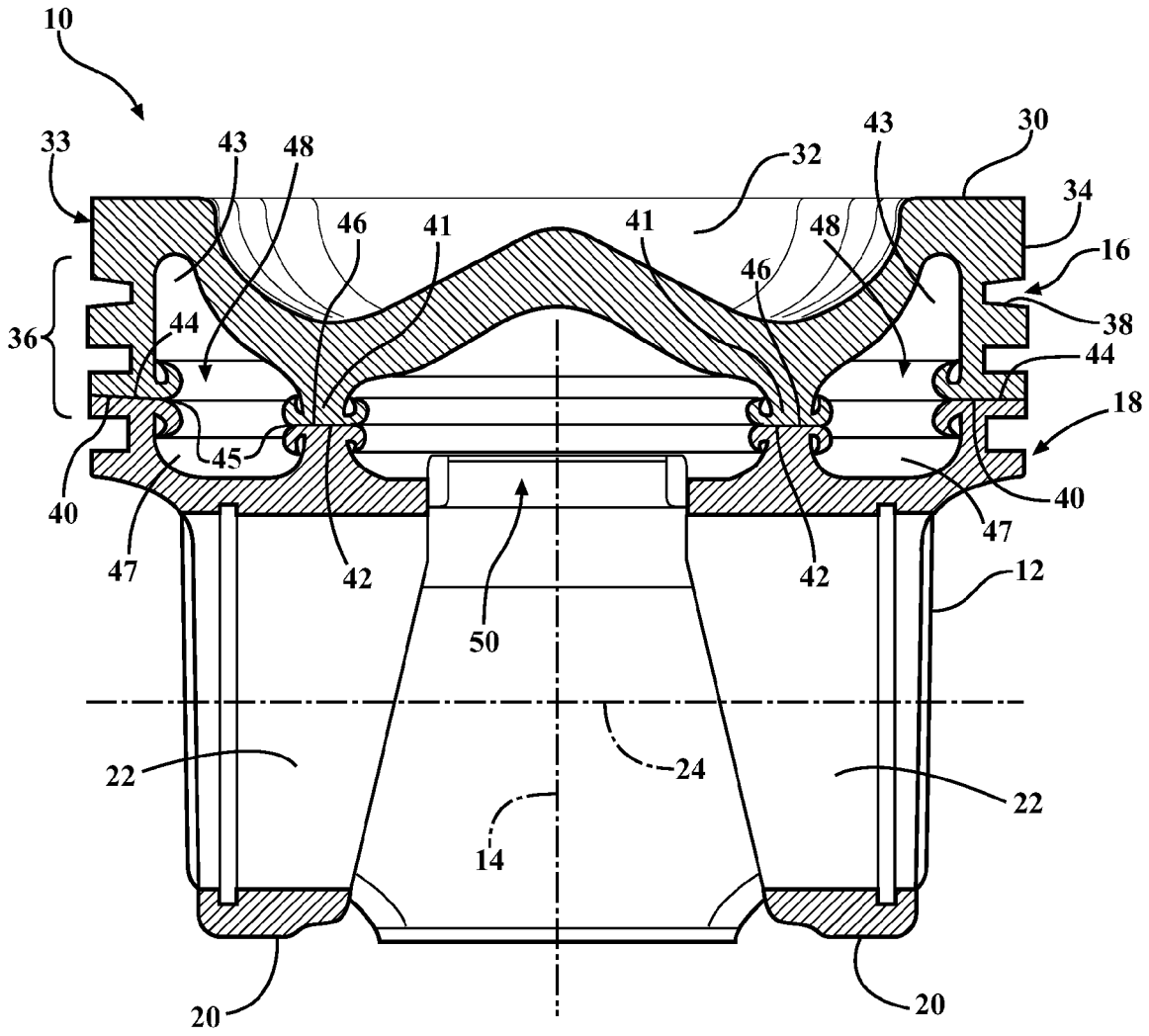
FIG. 2 is a cross-sectional view taken generally along a pin bore axis of the piston of FIG. 1.

Referring in more detail to the drawings, FIGS. 1 and 2 illustrate a piston assembly, referred to hereafter simply as piston 10, constructed according to one presently preferred embodiment of the invention for reciprocating movement in a cylinder bore or chamber (not shown) of an internal combustion engine, such as a heavy duty diesel engine, for example. The piston 10 has a body 12, either cast or forged, or formed by any other process of manufacture, extending along a central longitudinal axis 14 along which the piston 10 reciprocates in the cylinder bore. The body 12 has an upper crown 16 joined to a lower crown, also referred to as a lower piston portion 18. The lower crown 18 has a pair of pin bosses 20 depending from the upper crown 16 to provide laterally spaced pin bores 22 aligned along a pin bore axis 24 that extends generally transverse to the central longitudinal axis 14. The pin bosses 20 are joined to laterally spaced skirt portions 26 via strut portions 28. The skirt portions 26 are diametrically spaced from one another across opposite sides the pin bore axis 24 and have convex outer surfaces contoured for cooperation within the cylinder bore to maintain the piston 10 in a desired orientation as it reciprocates through the cylinder bore. The upper crown 16 is constructed as a monolithic piece from a first material, while the lower crown 18 is constructed from a separate piece from the upper crown 16 from a second material that is different from the first material. The first material has a lower thermal conductivity than the second material, wherein the first material is referred to hereafter as having a "low" thermal conductivity, with "low" being within a range of about 7 to 25 W/m-K. As such, the upper crown acts as a barrier to thermal conductivity to heat transfer from the upper crown 16 toward the lower crown 18, and thus, the heat generated within the cylinder bore above the upper crown 16 is substantially maintained in the cylinder bore, thereby improving fuel combustion, reducing formation of carbon build-up, increasing the exhaust gas temperature and otherwise enhancing the engine running performance.

The upper crown 16 of the piston 10 is represented here as having an upper combustion surface 30 with a combustion bowl 32 recessed therein to provide a desired gas flow with the cylinder bore. An outer wall 33, including an upper land 34 and a ring belt 36 extends downwardly from the upper surface 30 to an outer free end 40, with at least one annular ring groove 38 being formed in the ring belt 36 for floating receipt of a piston ring (not shown). An annular inner rib 41 depends from an under surface of the combustion bowl 32 to an inner free end 42, wherein the inner rib extends beneath the outer free end 40. Thus, the outer wall 33 and the inner rib 41 form an annular upper outer gallery portion 43. In accordance with one presently preferred embodiment, the upper crown 16 is constructed from a high grade stainless steel material, namely 400 series stainless steel having a chromium content of about 11.5-13.5 wt % and a thermal conductivity of about 23 W/m-K. In accordance with another presently preferred embodiment, the upper crown 16 is constructed from another high grade stainless steel material, namely 600 series stainless steel having a chromium content of about 15-17.5 wt % and a thermal conductivity of about 13 W/m-K. In accordance with yet another embodiment, the upper crown 16 is constructed from titanium having a thermal conductivity of about 7.8 W/m-K.

The lower crown 18 is constructed separately from the upper crown 16, such as in a forging process, by way of example and without limitation, and then joined to the upper crown 16 via an upstanding annular outer rib free end 44 and an upstanding annular inner rib free end 46, which form an annular lower outer gallery portion 47. The upper and lower crowns 16, 18 are represented here as being joined together by a friction weld or any other suitable type of weld joint 45 formed across the respective outer free ends 40, 44 and inner free ends 42, 46, for example. As such, a substantially closed outer oil gallery 48 is formed between the upper and lower crowns 16, 18, by the oppositely facing gallery portions 43, 47 while an open inner gallery 50 is formed upwardly of the pin bores 22 beneath a central portion of the combustion bowl 32. It should be recognized that the piston 10, constructed in accordance with the invention, could have upper and lower crown portions formed otherwise, having different configurations of oil galleries, for example. The lower crown 18 is constructed from any suitable economical material, and more preferably from an economical metal material, such as a low grade steel alloy, e.g. 4140H, or a micro-alloyed steel, for example.

In operation, the upper crown 16, being constructed from the "low" thermal conductivity steel, acts as a barrier to heat transfer to heat within the cylinder bore above the upper combustion surface 30. As such, the upper crown 16, and in particular, the region of the upper land 34 acts as an insulative heat sink, thereby elevating the upper land 34 in temperature during use above about 300 degrees Celsius. As such, carbon build-up is minimized on the upper land 34, and thus, the ring or rings (not shown) disposed in the ring groove 38 are not inhibited from sealing against the cylinder wall. It has been determined that carbon build-up tends to occur generally between about 200-300 degrees Celsius, and that above 300 degrees Celsius the carbon is burned off and thus, does not build up on the upper land 34. Accordingly, by ensuring the upper land remains at or above 300 degrees Celsius, the build-up of carbon is inhibited. In addition, by inhibiting the conductive transfer of heat downwardly through the upper crown 16, the exhaust gas is increased in temperature, thereby providing an added source of energy for use in other engine operations, such as a turbo compound, for example.

In accordance with another aspect of the invention, a method of constructing a piston 10 for an internal combustion engine is provided. The method includes forming an upper crown 16 as a monolithic piece of a first material having a thermal conductivity within a range of about 7 to 25 W/m-K with the upper crown 16 being formed having an upper combustion surface 30 with an upper land 34 depending therefrom, with the upper land 34 being formed having at least annular one ring groove 38 configured for receipt of a piston ring (not shown). The method further includes forming the upper crown 16 from one of a high grade stainless steel having between about 11.5 to 13.5 wt % chromium and a thermal conductivity of about 23 W/m-K; a high grade stainless steel having between about 15 to 18 wt % chromium and a thermal conductivity of about 13 W/m-K, or Titanium having a thermal conductivity of approximately 7.8 W/m-K. The method further includes forming a lower crown 18 of a low grade steel alloy material, such as having about 1 wt % chromium and a thermal conductivity of about 43 W/m-K, such that the lower crown 18 is formed having a thermal conductivity higher than the upper crown 16. Further yet, the method includes forming the lower crown 18 having a pair of pin bosses 20 providing a pair of laterally spaced, axially aligned pin bores 22. Then, welding the lower crown 18 directly to the upper crown 16, such as in a friction weld process, for example, wherein a depending outer wall 33 and a depending inner rib 41 of the upper crown 16 are welded to an upstanding annular outer rib free end 44 and an upstanding annular inner rib free end 46 of the lower crown 18, respectively, to form a substantially closed outer gallery 48.

Obviously, many modifications and variations of the present invention are possible in light of the above teachings. It is, therefore, to be understood that within the scope of the appended claims, the invention may be practiced otherwise than as specifically described.

What is claimed is:

1. A piston for an internal combustion engine, comprising:

an upper crown constructed as a monolithic piece of a 400 series or 600 series stainless steel having a thermal conductivity within a range of about 7 to 25 W/m-K, said upper crown having an upper combustion surface with an upper land depending therefrom, said upper land having at least one annular ring groove configured for receipt of a piston ring; and a lower piston portion welded directly to said upper crown, said lower piston portion being constructed of a low grade steel alloy material having a thermal conductivity higher than said upper crown, said lower piston portion having a pair of pin bosses providing a pair of laterally spaced, axially aligned pin bores.

2. The piston of claim 1 wherein the upper crown is constructed of 400 series stainless steel having between about 11.5 to 13.5 wt % chromium and a thermal conductivity of about 23 W/m-K.

3. The piston of claim 1 wherein the upper crown is constructed of 600 series stainless steel having between about 15 to 18 wt % chromium and a thermal conductivity of about 13 W/m-K.

4. The piston of claim 1 wherein the lower piston portion contains about 1 wt % chromium and a thermal conductivity of about 43 W/m-K.

5. The piston of claim 1 wherein said lower piston portion includes skirt portions laterally spaced from one another and joined to said pin bosses, wherein said skirt portions are constructed of said low grade steel alloy material.

6. The piston of claim 1 wherein said upper crown includes a combustion bowl recessed in said upper combustion surface, said upper crown includes an under surface facing opposite said combustion bowl and an annular inner rib depending from said under surface, said upper crown includes an outer wall extending downwardly from said upper combustion surface and including said upper land, said annular inner rib and said outer wall of said upper crown presenting an annular upper outer gallery portion;

said lower piston portion including strut portions and skirt portions each constructed of said low grade steel alloy material, said skirt portions having a convex outer surface and being laterally spaced from one another and joined to said pin bosses via said strut portions, said lower piston portion including an upstanding annular outer rib free end and an upstanding annular inner rib free end presenting an annular lower outer gallery portion, said upstanding annular outer rib free end of said lower piston portion being welded to said outer wall of said upper crown and said upstanding annular inner rib free end of said lower piston portion being welded to said annular inner rib of said upper crown such that said annular upper outer gallery portion and said annular lower outer gallery portion form an outer oil gallery and such that said upstanding annular inner rib free end of said lower piston portion and said annular inner rib of said upper crown form an open inner gallery along said under surface beneath said combustion bowl of said upper crown.

7. The piston of claim 1, wherein the weld between the lower piston portion and the upper crown includes a friction weld.

8. A method of constructing a piston for an internal combustion engine, comprising:

forming an upper crown as a monolithic piece of 400 series or 600 series stainless steel having a thermal conductivity within a range of about 7 to 25 W/m-K with the upper crown being formed having an upper combustion surface with an upper land depending therefrom, with the upper land having at least annular one ring groove configured for receipt of a piston ring; and forming a lower piston portion of a low grade steel alloy material having a thermal conductivity higher than the upper crown with the lower piston portion having a pair of pin bosses providing a pair of laterally spaced, axially aligned pin bores; and welding the lower piston portion directly to the upper crown.

9. The method of claim 8 further including forming the upper crown of 400 series stainless steel having between about 11.5 to 13.5 wt % chromium and a thermal conductivity of about 23 W/m-K.

10. The method of claim 9 further including forming the lower piston portion having about 1 wt % chromium and a thermal conductivity of about 43 W/m-K.

11. The method of claim 8 further including forming the upper crown of 600 series stainless steel having between about 15 to 18 wt % chromium and a thermal conductivity of about 13 W/m-K.

12. The method of claim 8 further including forming the lower piston portion having about 1 wt % chromium and a thermal conductivity of about 43 W/m-K.

13. The method of claim 8, wherein the step of forming the lower piston portion includes providing skirt portions laterally spaced from one another and joined to the pin bosses, wherein the skirt portions are constructed of the low grade steel alloy material.

14. The method of claim 8, wherein the step of forming the upper crown includes providing a combustion bowl recessed in the upper combustion surface, an under surface facing opposite the combustion bowl, an annular inner rib depending from the under surface, and an outer wall extending downwardly from the upper combustion surface and including the upper land;

the step of forming the lower piston portion includes providing skirt portions constructed of the low grade steel alloy material and having a convex outer surface and being laterally spaced from one another and joined to the pin bosses via strut portions, an upstanding annular outer rib free end, and an upstanding annular inner rib free end; and the step of welding the lower piston portion to the upper crown including welding the upstanding annular outer rib free end of the lower piston portion to the outer wall of the upper crown and the upstanding annular inner rib free end of the lower piston portion to the annular inner rib of the upper crown.

15. The method of claim 8, wherein the step of welding the lower piston portion to the upper crown includes friction welding.

* * * * *